US008185019B2

(12) United States Patent
Kato

(10) Patent No.: US 8,185,019 B2
(45) Date of Patent: May 22, 2012

(54) IMAGE-FORMING DEVICE FORMING IMAGES USING LIQUID CARRIER AND LIQUID DEVELOPER

(75) Inventor: Atsushi Kato, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 460 days.

(21) Appl. No.: 12/389,630

(22) Filed: Feb. 20, 2009

(65) Prior Publication Data

US 2009/0220281 A1 Sep. 3, 2009

(30) Foreign Application Priority Data

Feb. 29, 2008 (JP) ..... 2008-049535

(51) Int. Cl.
*G03G 15/10* (2006.01)

(52) U.S. Cl. ..... 399/238; 399/239

(58) Field of Classification Search ..... 399/237, 399/238, 239

See application file for complete search history.

(56) References Cited

U.S. PATENT DOCUMENTS

| | | | | |
|---|---|---|---|---|
| 5,293,913 | A | 3/1994 | Prezler | |
| 6,411,790 | B1 * | 6/2002 | Kim et al. | 399/238 |
| 6,778,799 | B2 | 8/2004 | Shin et al. | |

FOREIGN PATENT DOCUMENTS

| | | |
|---|---|---|
| JP | 05-262394 | 10/1993 |
| JP | 08-267775 | 10/1996 |
| JP | 10-301397 | 11/1998 |
| JP | 2000-037884 | 2/2000 |
| JP | 2003-270986 | 9/2003 |

* cited by examiner

*Primary Examiner* — Hoang Ngo
(74) *Attorney, Agent, or Firm* — Banner & Witcoff, Ltd.

(57) ABSTRACT

An image forming device with a liquid developer containing a developing agent and a liquid carrier is provided. The image-forming device includes a casing, an accumulation unit, a supply inlet, a cover, and a support part. The accumulation unit is provided in the casing for accumulating therein the liquid developer and the liquid carrier. The supply inlet is in communication with the accumulation unit and fluidly connectable with a replenishing container containing the liquid developer and the liquid carrier. The cover is configured to selectively provide an open phase and a closed phase with respect to the casing, and configured to expose the supply inlet at the open phase. The support part is provided on the cover and configured to detachably mount thereon the replenishing container at the open phase in an orientation capable of discharging the liquid developer and liquid carrier into the accumulation unit through the supply inlet.

14 Claims, 11 Drawing Sheets

IMAGE-FORMING DEVICE FORMING IMAGES USING LIQUID CARRIER AND LIQUID DEVELOPER

CROSS REFERENCE TO RELATED APPLICATIONS

This application claims priority from Japanese Patent Application No. 2008-049535 filed Feb. 29, 2008. The entire content of the priority application is incorporated herein by reference.

TECHNICAL FIELD

The present invention relates to an image-forming device that forms images using liquid developer formed of a developing agent and a liquid carrier.

BACKGROUND

An image-forming device using a liquid developing method such as that disclosed in Japanese unexamined patent application publication No. 2003-270986, is well known in the art. In general, this image-forming device forms images using a liquid developer formed of a developing agent dispersed in a liquid carrier. Since the image-forming device using the liquid developing method can employ a finer developing agent, the image-forming device can form images of higher resolution.

Consideration has been given to providing a structure in this type of image-forming device enabling liquid developer to be supplied externally to liquid developer tanks provided in a body of the image-forming device for storing the liquid developer. Here, it is conceivable that the user could supply liquid developer to the liquid developer tanks from a bottle filled with the liquid developer, but this would require the user to hold a heavy bottle throughout the operation for filling each of the liquid developer tanks in the conventional image-forming device and thus would not be convenient for the user.

SUMMARY

In view of the foregoing, it is an object of the present invention to provide an image-forming device with improved operability for supplying a liquid developer or a liquid carrier to liquid developer tanks provided in the device body.

In order to attain the above object, the invention provides an image forming device. The image forming device is provided for forming an image with liquid developer containing developing agent and liquid carrier. The image-forming device includes a casing, an accumulation unit, a supply inlet, a cover, and a support part. The accumulation unit is provided in the casing for accumulating therein one of the liquid developer and the liquid carrier. The supply inlet is in communication with the accumulation unit and fluidly connectable with a replenishing container containing one of the liquid developer and the liquid carrier. The cover is configured to selectively provide an open phase and a closed phase with respect to the casing, and configured to expose the supply inlet at the open phase. The support part is provided on the cover and configured to detachably mount thereon the replenishing container at the open phase in an orientation capable of discharging one of the liquid developer and the liquid carrier into the accumulation unit through the supply inlet.

According to another aspect, present invention provides an image forming device for forming an image with color material. The image-forming device includes a casing, an accumulation unit, a supply inlet, a cover, and a support part. The accumulation unit is provided in the casing for accumulating therein the color material. The supply inlet is in communication with the accumulation unit and fluidly connectable with a replenishing container containing the color material. The cover is configured to selectively provide an open phase and a closed phase with respect to the casing, and configured to expose the supply inlet at the open phase. The support part is provided on the cover and configured to detachably mount thereon the replenishing container at the open phase in an orientation capable of discharging the color material into the accumulation unit through the supply inlet.

DETAILED DESCRIPTION

An image forming device according to one embodiment of the present invention will be described below.

Figure 1:
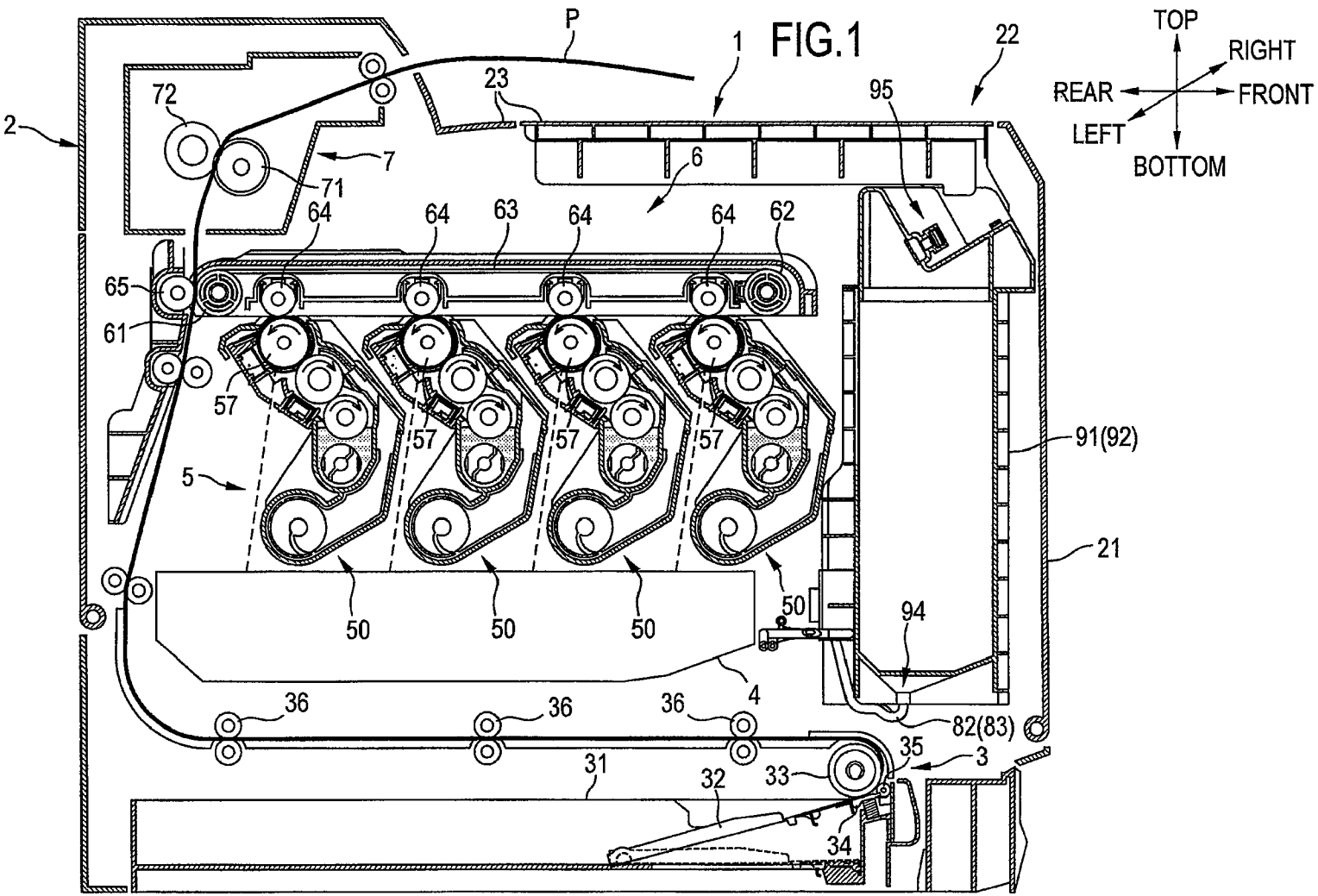
FIG. 1 is a cross-sectional view showing the overall structure of a color printer serving as one embodiment of the image-forming device.

In the following description, directions will be described based on the position of the user when the user is using the color printer and when the user is supplying liquid developer (or a liquid carrier). In FIG. 1, for example, the right side of the drawing will be referred to as the "front" side, the left side as the "rear" side, the far side of the drawing as the "right" side, and the near side as the "left" side. In addition, the top and bottom sides of the drawing will be referred to as the "top" and "bottom," respectively.

Figure 2:
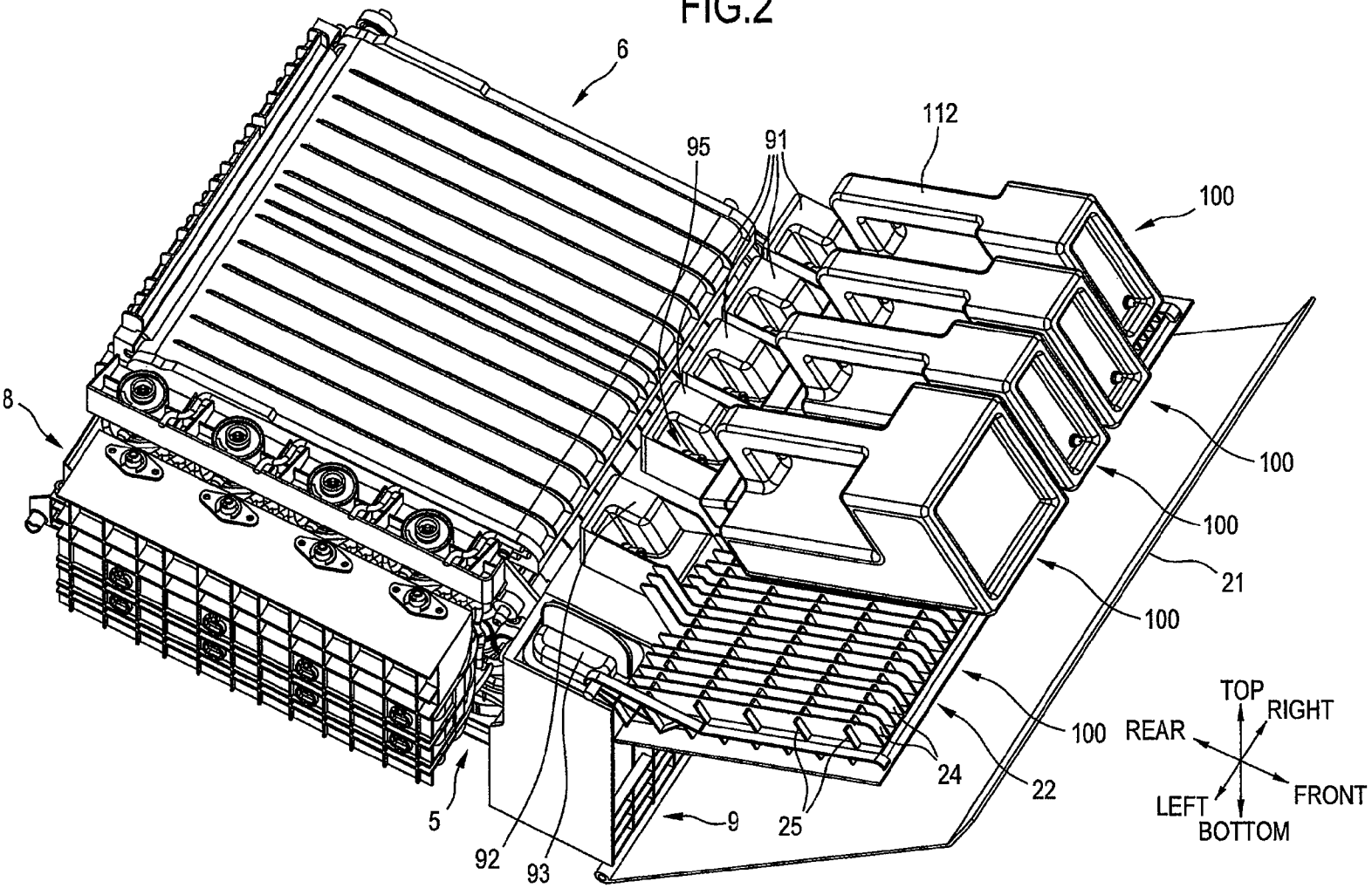
FIG. 2 is a perspective view illustrating positional relationships among a process section, a transfer section, a regulating section, and a tank section.

As shown in FIG. 1, a color printer 1 has a main casing 2 constituting a device body. Within the main casing 2, the color printer 1 includes a feeding section 3 for feeding a paper P into the color printer 1, an exposure section 4 for forming images on the paper P fed from the feeding section 3, a process section 5, a transfer section 6, and a fixing section 7. As shown in FIG. 2, the color printer 1 also includes a regulating section 8 for regulating the concentration of liquid developer supplied to the process section 5, and a tank section 9 accumulating liquid developer in each of the colors cyan, magenta, yellow, and black; and a liquid carrier.

The main casing 2 includes a front cover 21 on the front side thereof that is rotatable forward and backward about a first supporting point on the bottom edge of the front cover 21, and an upper cover 22 disposed on the top and near the front side thereof that is rotatable about a second supporting point on the front edge of the upper cover 22. A discharge tray 23 is provided on the top of the main casing 2 for accumulating the paper P discharged from the main casing 2. As shown in FIG. 1, the top surface of the upper cover 22 also serves as part of the discharge tray 23 when the upper cover 22 is closed.

The feeding section 3 will be described in detail. The feeding section 3 is disposed in the bottom section of the main casing 2 and includes a paper cassette 31 that can be withdrawn from the main casing 2 in the forward direction, a paper-pressing plate 32 disposed in the paper cassette 31, a feeding roller 33, a separation pad 34, a paper dust roller 35 disposed above the front side of the paper cassette 31, and a plurality of pairs of conveying rollers 36 disposed above the paper cassette 31 at intervals in the front-to-rear direction. The paper-pressing plate 32 in the feeding section 3 pushes the paper P accommodated in the paper cassette 31 toward the feeding roller 33. The feeding roller 33 and the separation pad 34 cooperate to feed the paper P one sheet at a time onto a conveying channel that passes by the paper dust roller 35 and the pairs of conveying rollers 36 and continues downstream to the transfer section 6.

Details of the exposure section 4 will be described. The exposure section 4 is disposed above the paper cassette 31 and between the paper cassette 31 and the process section 5. The exposure section 4 has a construction well known in the art that includes laser light-emitting units, a polygon mirror, a plurality of lenses, and a plurality of reflecting mirrors, none of which are shown in the drawings. The laser light-emitting units in the exposure section 4 project laser beams to the process section 5.

Details of the process section 5 will be described. The process section 5 is disposed above the exposure section 4 and between the exposure section 4 and the transfer section 6. The process section 5 is primarily configured of four process units 50 juxtaposed in the front-to-rear direction. The process units 50 all have the same construction, differing only in the color of toner, i.e., the solid particles in the liquid developer supplied from the regulating section 8. The liquid developer is formed by dispersing toner as an example of a developing agent in a nonvolatile liquid carrier.

Figure 3:
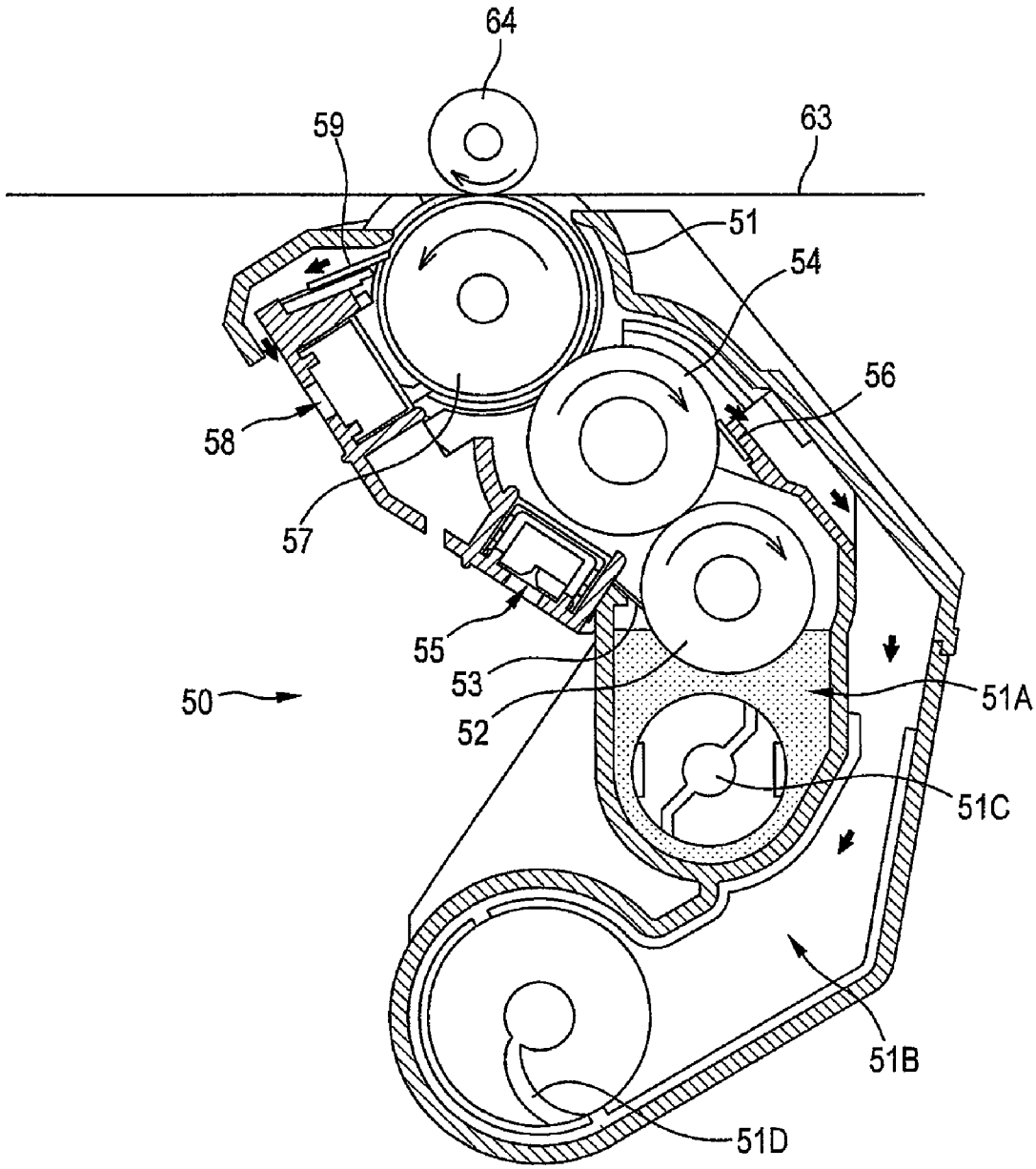
FIG. 3 is an enlarged view of a process unit.

As shown in FIG. 3, each of the process units 50 is primarily configured of a frame 51 constituting the outer structure and, within the frame 51, a supply roller 52, a first blade 53 for regulating the thickness of liquid developer on the supply roller 52, a developing roller 54, a first charger 55, a second blade 56 for returning the liquid developer on the developing roller 54, a photosensitive drum 57, a second charger 58, and a third blade 59 for removing the waste liquid developer on the photosensitive drum 57.

In addition to forming the outer structure of the process unit 50, the frame 51 also configures a first reservoir 51A for retaining the liquid developer to be supplied to the supply roller 52, and a second reservoir 51B for retaining liquid developer collected from the developing roller 54.

As shown in FIG. 3, agitators 51C and 51D are provided in the first and second reservoirs 51A and 51B, respectively. The agitators 51C and 51D agitate the liquid developer stored in the respective reservoir in order to uniformly disperse toner in the liquid carrier. The action of the agitators 51C and 51D charges the toner dispersed in the liquid carrier at this time.

The supply roller 52 is a metal roller in the surface of which is formed a plurality of grooves (not shown) running in the circumferential direction of the roller. The supply roller 52 rotates while carrying liquid developer stored in the first reservoir 51A on the surface thereof in order to supply the liquid developer to the developing roller 54.

The first blade 53 slidingly contacts the surface of the rotating supply roller 52 at a position upstream of the position that the supply roller 52 slidingly contacts the developing roller 54 relative to the rotating direction of the supply roller 52. The first blade 53 functions to regulate the thickness of liquid developer carried on the surface of the supply roller 52.

The developing roller 54 carries liquid developer supplied from the supply roller 52 on the surface thereof and supplies this liquid developer to an electrostatic latent image formed on the surface of the photosensitive drum 57 in order to form a toner image on the photosensitive drum 57.

The first charger 55 is disposed at a position away from the developing roller 54 by a prescribed distance opposing to the developing roller 54. The first charger 55 functions to attract toner within the liquid developer carried on the developing roller 54 toward the surface of the liquid carrier (or toward the surface of the developing roller 54).

The second blade 56 slidingly contacts the surface of the rotating developing roller 54 at a position downstream from the position at which the developing roller 54 slidingly contacts the photosensitive drum 57 relative to the rotating direction of the developing roller 54. The second blade 56 functions to recover liquid developer remaining on the developing roller 54. The recovered liquid developer is collected in the second reservoir 51B.

A laser beam irradiated from the exposure section 4 onto the surface of the photosensitive drum 57 forms an electrostatic latent image thereon. The toner in the liquid developer supplied from the supply roller 52 to the photosensitive drum 57 via the developing roller 54 develops the electrostatic latent image on the photosensitive drum 57 into a visible toner image.

The second charger 58 is disposed at a position away from the photosensitive drum 57 at a prescribed distance so as to oppose but not contact the photosensitive drum 57. The second charger 58 functions to apply a uniform charge to the surface of the photosensitive drum 57.

The third blade 59 slidingly contacts the surface of the rotating photosensitive drum 57 at a position immediately above the second charger 58 and upstream of the second charger 58 relative to the rotational direction of the photosensitive drum 57. The third blade 59 functions to remove liquid developer remaining on the photosensitive drum 57 after a transfer operation. The liquid developer remaining on the photosensitive drum 57 after the transfer operation (referred to as waste liquid developer) includes a mixture of paper dust and toner in different colors.

Details of the transfer section 6 will be described. As shown in FIG. 1, the transfer section 6 is disposed immediately above the process section 5, and more specifically between the process section 5 and the discharge tray 23. The transfer section 6 includes a drive roller 61, a follow roller 62, an intermediate transfer belt 63, four primary transfer rollers 64, and a secondary transfer roller 65.

The drive roller 61 and follow roller 62 are arranged parallel to one another and separated in the front-to-rear direction. An endless intermediate transfer belt 63 is looped around the drive roller 61 and follow roller 62. The photosensitive drums 57 oppose and contact the outer surface of the intermediate transfer belt 63 on the bottom thereof, while the secondary transfer roller 65 opposes and contacts the outer surface of the intermediate transfer belt 63 on the rear side.

The follow roller 62 is urged in the forward direction in order to apply tension to the intermediate transfer belt 63.

Each of the primary transfer rollers 64 is disposed in opposition to one of the photosensitive drums 57 and contacts the inner bottom surface of the intermediate transfer belt 63 pinching the intermediate transfer belt 63 against the photosensitive drum 57. The secondary transfer roller 65 is disposed in opposition to the drive roller 61 pinching the intermediate transfer belt 63 against the drive roller 61. During a transfer operation, a transfer bias is applied to the primary transfer rollers 64 and the secondary transfer roller 65.

With the process section 5 and transfer section 6 having the above construction, each second charger 58 first applies a uniform charge to the surface of the respective photosensitive drum 57, and the surface of the photosensitive drum 57 is subsequently exposed to a laser beam emitted from the exposure section 4 based on image data. Irradiating the surface of the photosensitive drum 57 with a laser beam lowers the potential in the exposed areas, thereby forming an electrostatic latent image on the photosensitive drum 57.

As the supply roller 52 rotates, liquid developer stored in the first reservoir 51A is carried on the surface of the supply roller 52 and is supplied to the developing roller 54 as the surface of the supply roller 52 rotates in contact with the surface of the developing roller 54. As the surface of the developing roller 54 rotates in contact with the surface of the photosensitive drum 57, toner in the liquid developer carried on the developing roller 54 is supplied to the electrostatic latent image formed on the photosensitive drum 57.

In this way, the toner is selectively carried on the photosensitive drum 57, developing the electrostatic latent image into a visible toner image. By applying a transfer bias to each primary transfer roller 64, the primary transfer rollers 64 function to sequentially transfer toner images in each color formed on the photosensitive drums 57 onto the intermediate transfer belt 63 so that the toner images are superimposed over each other. When a transfer bias is applied to the secondary transfer roller 65, the secondary transfer roller 65 causes the toner images transferred onto the intermediate transfer belt 63 to be transferred onto a sheet of paper P conveyed from the feeding section 3 as the sheet of paper P passes between the intermediate transfer belt 63 and the secondary transfer roller 65.

Details of the fixing section 7 will be described. The fixing section 7 is provided above the rear side of the transfer section 6. The fixing section 7 includes a heating roller 71, a pressure roller 72 disposed in opposition to the heating roller 71 and applying pressure to the same, and a pair of discharge rollers 73. After the toner images are transferred onto a sheet of paper P, the toner images are fixed to the sheet by heat in the fixing section 7 as the sheet passes between the heating roller 71 and pressure roller 72. The discharge rollers 73 subsequently discharge the sheet of paper P out of the main casing 2, where the sheet is accumulated on the discharge tray 23.

Details of the regulating section 8 will be described. The regulating section 8 is disposed on the left side of the process section 5 as shown in FIG. 2. The regulating section 8 includes four regulating tanks 80 (see FIG. 4) juxtaposed in the front-to-rear direction on the left side of the respective process units 50 and an agitator 81 for agitating each regulating tank 80.

The agitator 81 is provided in each regulating tank 80. Although some parts of the structure are omitted in FIG. 4, each regulating tank 80 is linked to the respective first reservoir 51A by a first supply channel 84, and to the respective second reservoir 51B by a first recovery channel 85.

Figure 4:
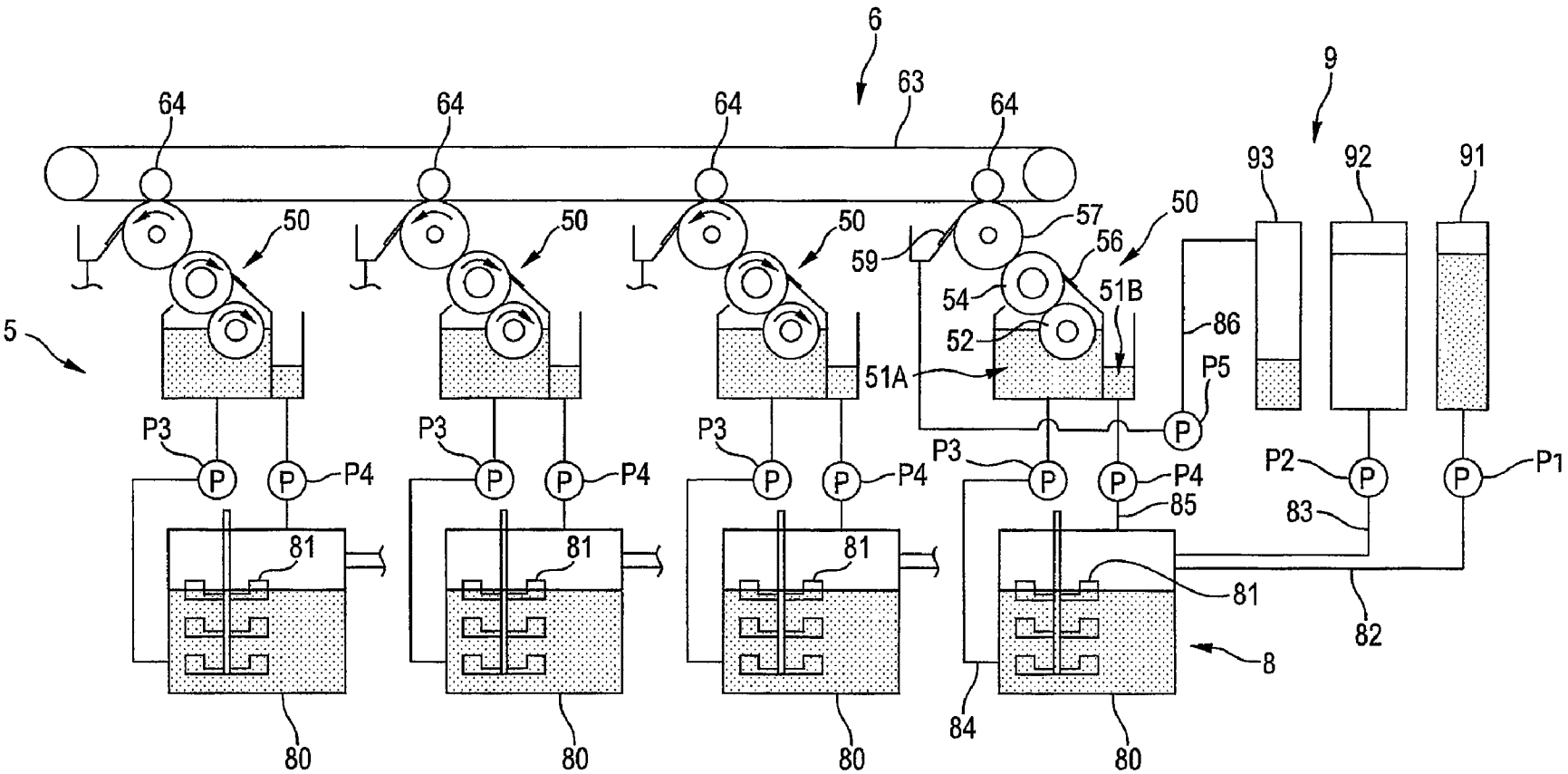
FIG. 4 is an explanatory diagram conceptually illustrating structures of the process section, the regulating section, and the tank section.

As shown in FIG. 4, a pump P3 is adapted for supplying liquid developer to the first reservoir 51A after the concentration of the liquid developer has been regulated in a regulating tank 80 of the regulating section 8 through the first supply channel 84. A pump P4 is adapted for feeding liquid developer collected at the second reservoir 51B to the regulating tank 80 of the regulating section 8 through the first recovery channel 85.

Details of the tank section 9 will be described. As shown in FIG. 2, the tank section 9 is disposed forward of the process section 5 and transfer section 6. The tank section 9 includes four of the liquid developer tanks 91 for accumulating liquid developer in which toner of each color has been dispersed, a liquid carrier tank 92 for accumulating liquid carrier, and the waste liquid developer cartridge 93 for accumulating recovered waste liquid developer. As shown in FIG. 4, the liquid developer tank 91 is fluidly connected to the corresponding regulating tank 80 by a second supply channel 82. The liquid carrier tanks 92 are fluidly connected to the each regulating tank 80 by a third supply channel 83. A pump P1 is adapted for supplying the liquid developer to the regulating tank 80. A pump P2 is adapted for supplying the liquid carrier to the regulating tank 80.

The waste liquid developer cartridge 93 is exposed to an atmosphere in the top of the main casing 2 by opening the front cover 21 and upper cover 22. At this time, the waste liquid developer cartridge 93 can be removed from or mounted in the main casing 2 (tank section 9).

As shown in FIG. 4, a pump P5 is provided for conveying the waste liquid developer removed by the third blade 59 along a second recovery channel 86 for recovering the waste liquid developer. The waste liquid developer is subsequently recovered in a waste liquid developer cartridge 93 provided in the tank section 9. Although part of the structure is omitted in FIG. 4, each of the process units 50 is fluidly connected to the waste liquid developer cartridge 93 in the tank section 9 by the second recovery channel 86 on which the pump P5 is provided.

Here, the method of regulating the concentration of liquid developer in the regulating tank 80 will be described below. In addition to the agitator 81, the regulating tank 80 is provided with a liquid level sensor for detecting the surface height of the liquid developer, a viscosity sensor mounted on the agitator 81 for detecting the viscosity of the liquid developer, and a pump controller for controlling the pumps P1-P4 based primarily on the sensors' output values (the sensors and pump controller are not shown in the drawings).

After liquid developer recovered from the developing roller 54 is transferred from the second reservoir 51B via the first recovery channel 85 and collected in the regulating tank 80, the pump P1 supplies liquid developer from the liquid developer tank 91 to the regulating tank 80 via the second supply channel 82 until the liquid developer in the regulating tank 80 reaches a prescribed volume (a prescribed height). Next, the concentration of the liquid developer in the regulating tank 80 (the amount of toner in the liquid carrier) is calculated by driving the agitator 81 in order to measure the viscosity of the liquid developer. While the agitator 81 is continually driven, a pump P2 supplies liquid carrier from the liquid carrier tank 92 via the third supply channel 83 (or the pump P1 supplies liquid developer from the liquid developer tank 91 via the second supply channel 82) until the concentration of the liquid developer reaches a preset value. After the concentration of the developer is adjusted, the pump P3 supplies the liquid developer from the regulating tank 80 to the first reservoir 51A via the first supply channel 84.

Next, a construction for supplying liquid developer (or liquid carrier) to the liquid developer tank 91 (or the liquid carrier tank 92) will be described. This construction is a feature of the present invention.

Figure 5A:
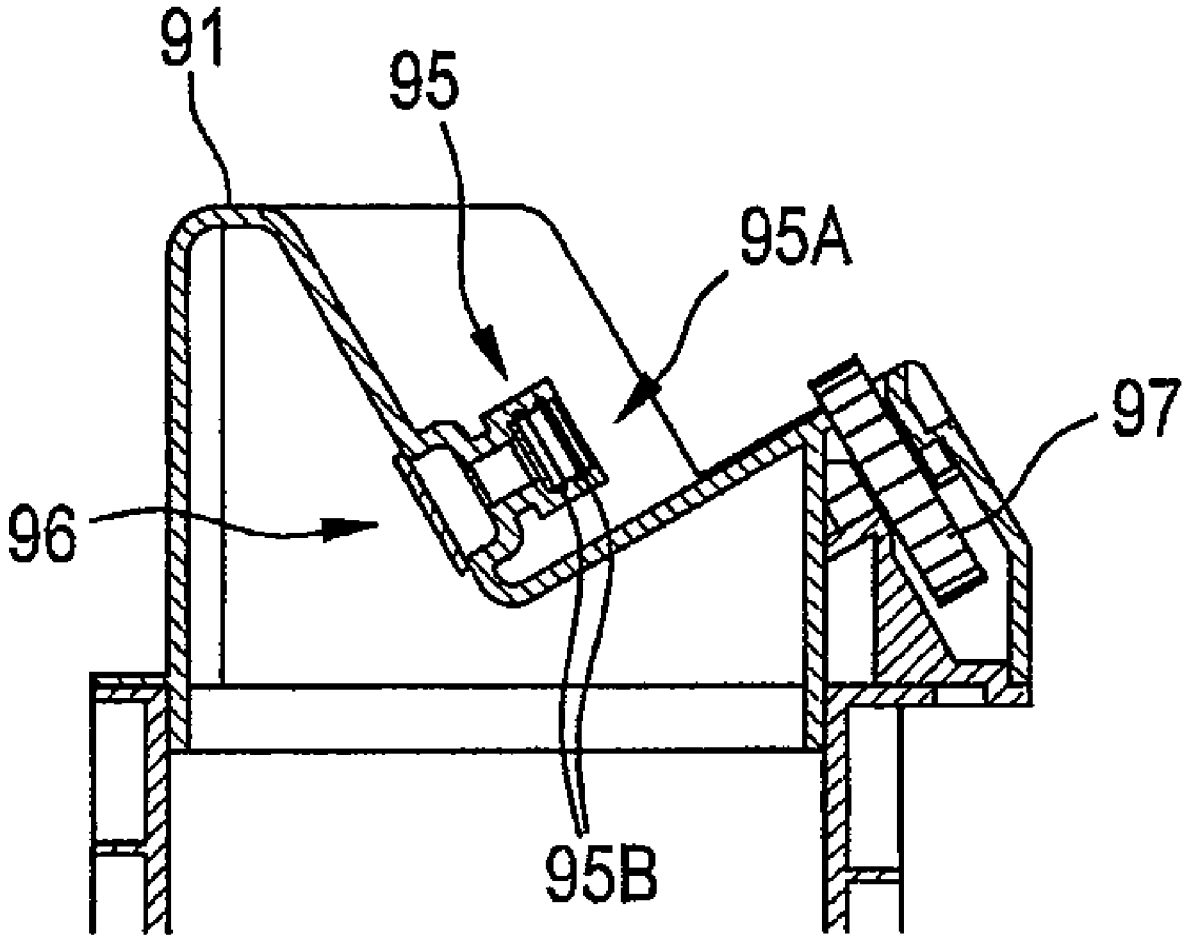
FIG. 5A is a cross-sectional view of the top portion of a liquid developer tank.

As shown in FIG. 1, each liquid developer tank 91 is a container-like member elongated vertically and functions to accumulate liquid developer that will be supplied to the respective regulating tank 80. An outlet 94 is formed in the bottom of the liquid developer tank 91 and is in fluid communication with the second supply channel 82. As shown in FIG. 5A, the liquid developer tank 91 also includes a mounting part 95 disposed on the top thereof for mounting a bottle, a valve 96 well known in the art that can be controlled to open and close, a drive gear 97, and an agitator (not shown) well known in the art for agitating liquid developer accumulated in the liquid developer tank 91.

Figure 5B:
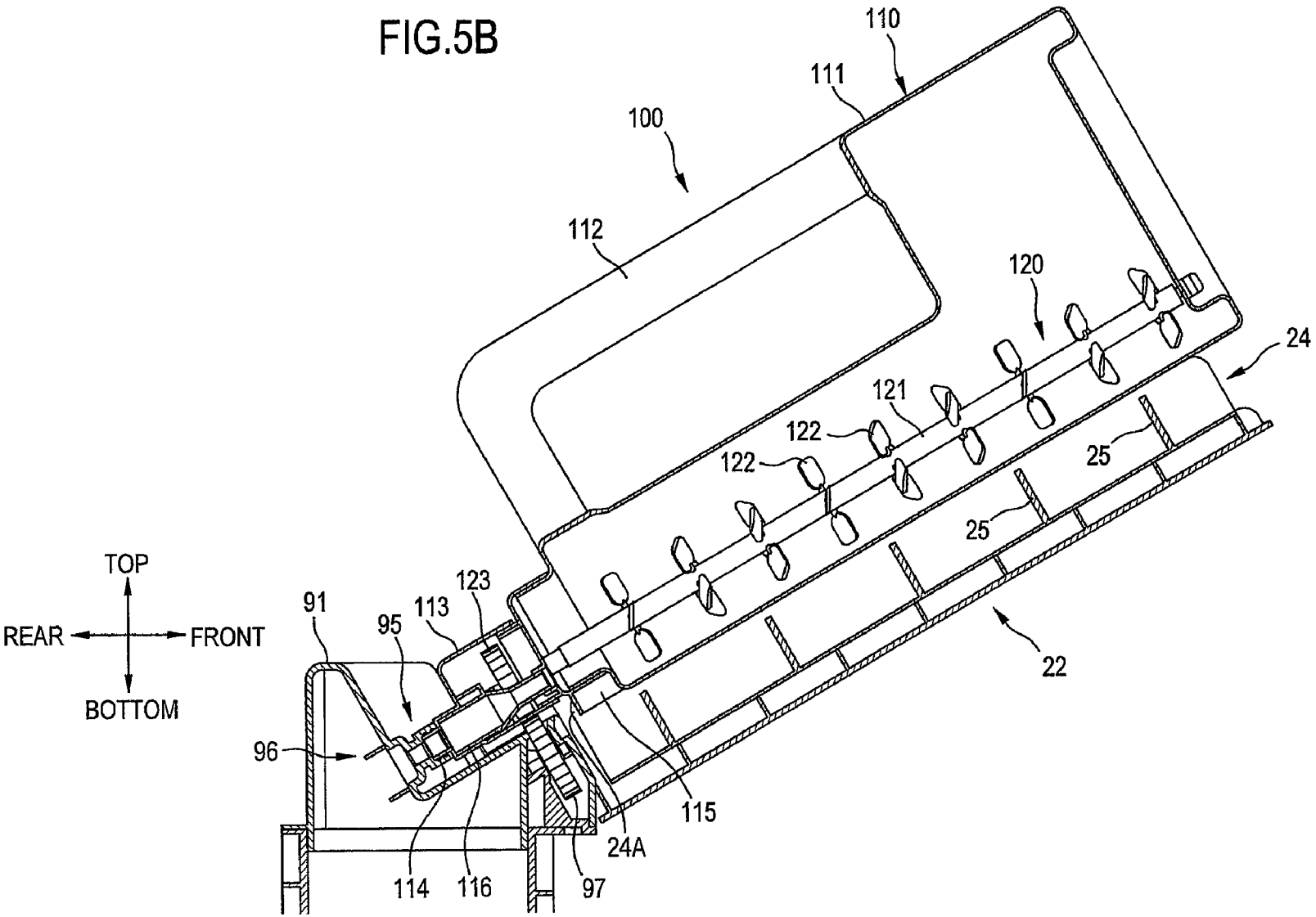
FIG. 5B is a cross-sectional view of a liquid developer bottle mounted on the liquid developer tank.

As shown in FIGS. 5A and 5B, the mounting part 95 is a part on which a liquid developer bottle 100 can be detachably mounted. The mounting part 95 includes an inlet 95A through which liquid developer from the bottle 100 can be supplied into the liquid developer tank 91, and a seal 95B disposed inside the mounting part 95 to close any gaps formed between the mounting part 95 and the liquid developer bottle 100 mounted on the mounting part 95 in order to prevent liquid developer from leaking.

A control unit 10 described later controls the valve 96 to open and close. By opening and closing the valve 96, the path between the interior and exterior of the liquid developer tank 91 via the inlet 95A can be switched between a communicating state and a non-communicating state. The valve 96 is always closed when the liquid developer bottle 100 is not mounted. Control by the control unit 10 to open and close the valve 96 when the liquid developer bottle 100 is mounted will be described later.

Figure 7A:
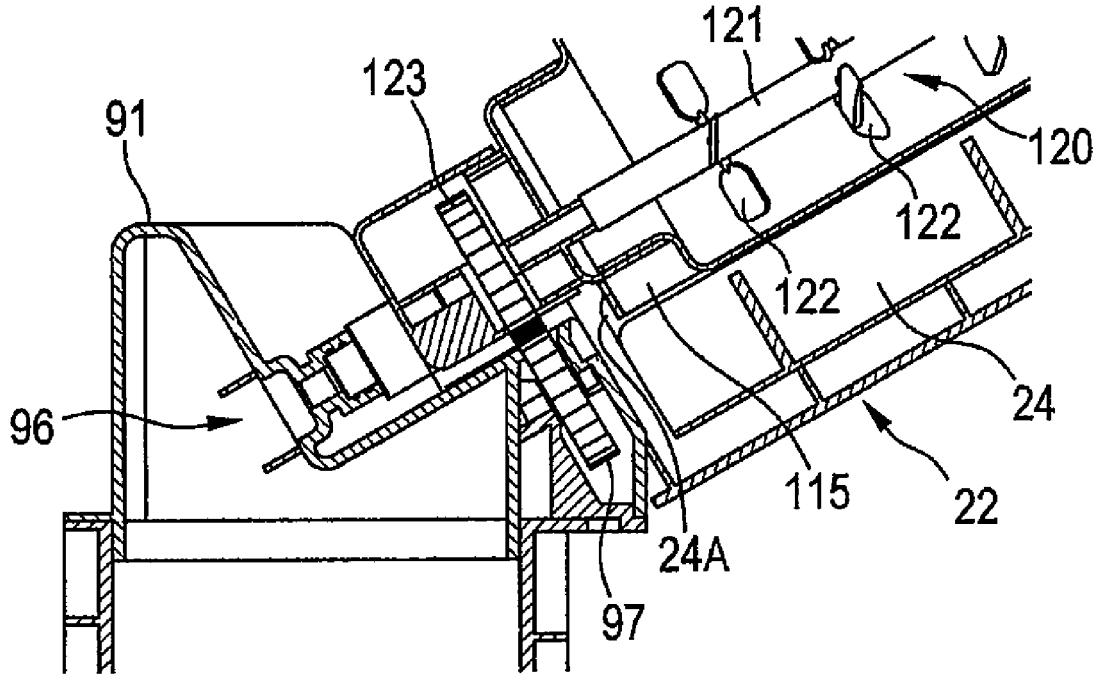
FIG. 7A is a cross-sectional view of the bottle mounted in the liquid developer tank when a drive gear is meshed with an input gear.

The drive gear 97 functions to transmit a drive force of a motor 27 (see FIG. 8) provided inside the main casing 2 to an agitator 120 provided inside the liquid developer bottle 100 when the liquid developer bottle 100 is mounted on the mounting part 95. Further, the drive gear 97 engages with an input gear 123 provided with the liquid developer bottle 100, as shown in FIG. 7A, when the liquid developer bottle 100 is mounted on the mounting part 95.

As shown in FIG. 1, the liquid carrier tank 92 is a container-like member elongated vertically and accumulates a liquid carrier that will be supplied to the respective regulating tank 80. The liquid carrier tank 92 has substantially the same structure as the liquid developer tank 91, except that the storage capacity of the liquid carrier tank 92 is greater than that of the liquid developer tank 91 and the liquid carrier tank 92 is not provided with the drive gear 97. Therefore, the detailed description of the liquid carrier tank 92 is omitted.

The upper cover 22 is configured to be rotatable between a closed position shown in FIG. 1 and an open position shown in FIG. 5B. By opening the upper cover 22 after first opening the front cover 21, the mounting part 95 (inlet 95A) can be exposed externally, as shown in FIG. 2. When rotated to its maximum open position, the upper cover 22 slopes diagonally upward from the mounting part 95, as shown in FIG. 5B.

A plurality of ribs 24 (see FIG. 2) extending in the front-to-rear direction, and a plurality of reinforcing ribs 25 extending in the left-to-right direction so as to intersect the ribs 24 are provided on the surface of the upper cover 22 that faces upward when the upper cover 22 is in the open position. The liquid developer bottle 100 mounted on the mounting part 95 is supported by the ribs 24 in a position for supplying liquid developer into the liquid developer tank 91.

Figure 6:
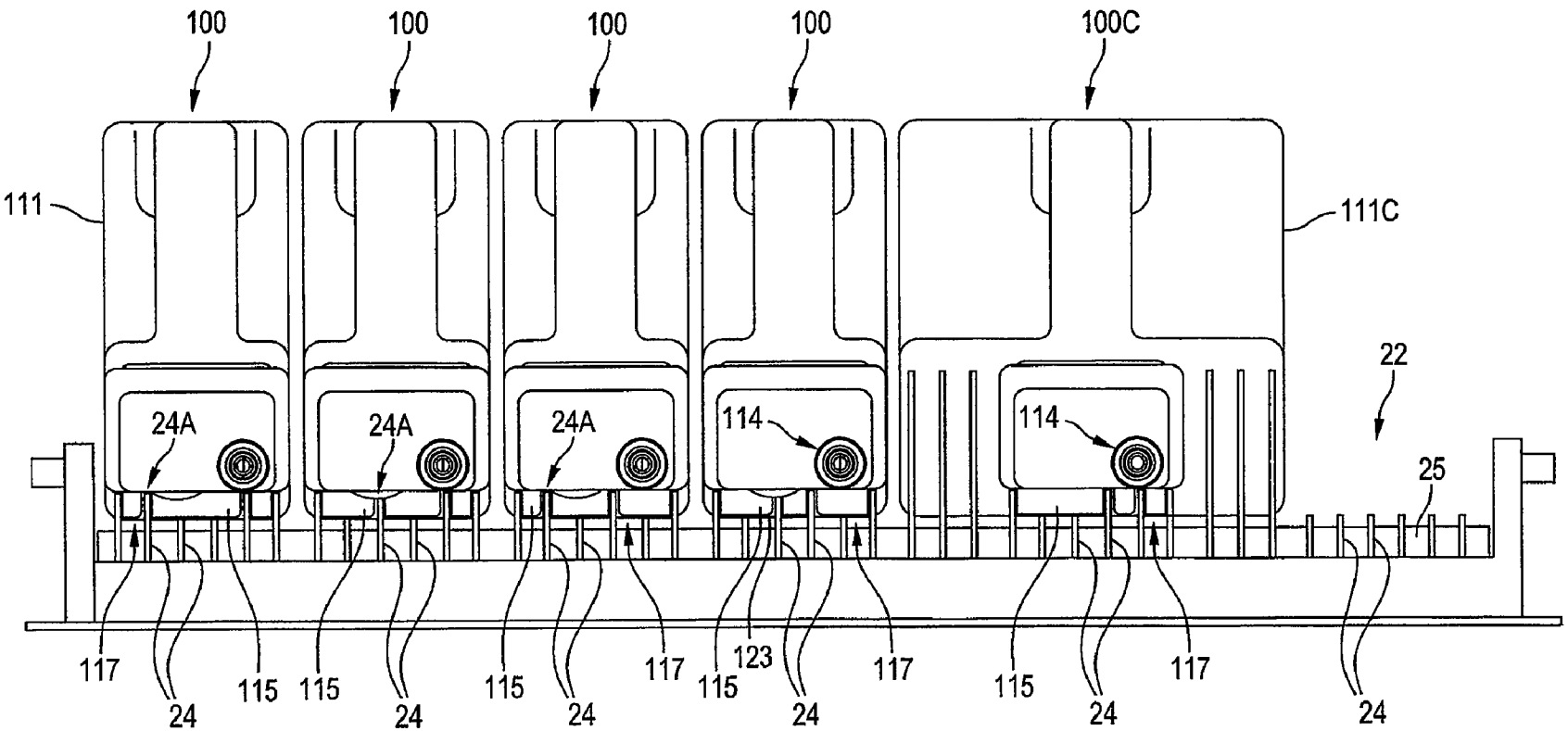
FIG. 6 is a schematic diagram of an upper cover and bottles as viewed from the bottle mounting part side.

As shown in FIG. 6, a single liquid developer bottle 100 (or a liquid carrier bottle 100C) is supported on a plurality (six for the liquid developer bottle 100 and twelve for the liquid carrier bottle 100C in the preferred embodiment) of the ribs 24. Some of these ribs 24 are provided with a protruding part 24A on the inlet 95A side of the ribs 24 (the near side in FIG. 6) and some are not. The protruding parts 24A function to prevent incorrect mounting of the liquid developer bottles 100 or the liquid carrier bottle 100C.

In the example of FIG. 6, the protruding parts 24A are provided on the first, second, fifth, and sixth ribs 24 supporting the leftmost liquid developer bottle 100, but are not provided on the two center ribs 24. For the liquid developer bottle 100 mounted on the rightmost, the protruding parts 24A are provided on the two side ribs 24 and the two center ribs 24, but are not provided on the second and fifth ribs 24.

In this way, a specific pattern combining ribs 24 with the protruding part 24A and the ribs 24 without the protruding parts 24A is formed on the inlet 95A side of the six ribs 24 supporting a single liquid developer bottle 100 (or liquid carrier bottle 100C). These specific patterns are formed at a total of five locations corresponding to the bottles 100 and 100C. The patterns are uniquely different.

Next, the structure of the liquid developer bottle 100 and the liquid carrier bottle 100C will be described. Directions given in the following description will be based on the orientation of the bottle when the bottle is mounted on the mounting part 95.

Each liquid developer bottle 100 is detachably mounted in the main casing 2 (on the mounting part 95) and accumulates liquid developer supplied for image formation. As shown in FIG. 5B, the liquid developer bottle 100 primarily includes a bottle frame 110, and the agitator 120 provided inside the bottle frame 110.

The bottle frame 110 is primarily configured of a liquid developer accumulating section 111 that is L-shaped in a side view and functions to accumulate liquid developer, a handle 112, a gear accumulating section 113 provided diagonally beneath the liquid developer accumulating section 111, a bottle side mounting part 114 for connecting with the mounting part 95, a sensing unit 115 for sensing when the liquid developer bottle 100 is incorrectly mounted, and a replenishing channel 116 for connecting the liquid developer accumulating section 111 and the bottle side mounting part 114.

The agitator 120 agitates the liquid developer accumulated in the liquid developer accumulating section 111 in order to disperse the toner uniformly in the liquid developer (liquid carrier). The agitator 120 is configured of a shaft 121 rotatably supported in the bottle frame 110, a plurality of agitating blades 122 fixed to the shaft 121, and the input gear 123 mentioned earlier.

The shaft 121 protrudes out of the liquid developer accumulating section 111 into the gear accumulating section 113. The input gear 123 is disposed in the gear accumulating section 113 and is fixed on the protruding end of the shaft 121. The bottom of the input gear 123 is exposed through an opening formed in the gear accumulating section 113 (see FIG. 6). The input gear 123 engages with the drive gear 97 when the liquid developer bottle 100 is mounted on the mounting part 95, as shown in FIG. 7A. Although not shown in the drawing, a bearing and seal are provided on the end of the shaft 121 that protrudes into the gear accommodating section 113.

The bottle side mounting part 114 is the portion of the liquid developer bottle 100 that mounts onto the mounting part 95. Hence, the liquid developer bottle 100 is mounted on the main casing 2 by engaging the bottle side mounting part 114 and mounting part 95. The bottle side mounting part 114 is cylindrical in shape, and the inside of the cylindrical shape is in fluid communication with the liquid developer accumulating section 111 via the replenishing channel 116. The bottle side mounting part 114 is also provided with a seal, a valve, or another opening/closing member well known in the art (not shown) for setting the interior and exterior of the liquid developer accumulating section 111 in a communicating state when the bottle side mounting part 114 is correctly engaged with the mounting parts 95, and in a non-communicating state at all other time.

A plurality of recessed parts 117 having a specific pattern is formed in each sensing unit 115, as shown in FIG. 6. The specific pattern formed by the recessed parts 117 differs for each type of liquid developer bottle 100, i.e., for each color of toner dispersed in the liquid developer accumulated in each liquid developer accumulating section 111. The specific patterns of the recessed parts 117 have a one-on-one correspondence to the specific patterns of the ribs 24 (protruding parts 24A) positioned near the inlet 95A to ensure that the color of toner dispersed in the liquid developer accumulated in the liquid developer accumulating section 111 matches the color of toner dispersed in the liquid developer accumulated in the corresponding liquid developer tank 91.

As shown in FIGS. 5B and 7A, the protruding parts 24A engage in the recessed parts 117 when the specific pattern formed by the protruding parts 24A on the ribs 24 matches the specific pattern formed by the recessed parts 117 in the sensing unit 115. Hence, the liquid developer bottle 100 is mounted on the main casing 2 by engaging the bottle side mounting part 114 and the mounting part 95. At this time, the input gear 123 also meshes with the drive gear 97.

Figure 7B:
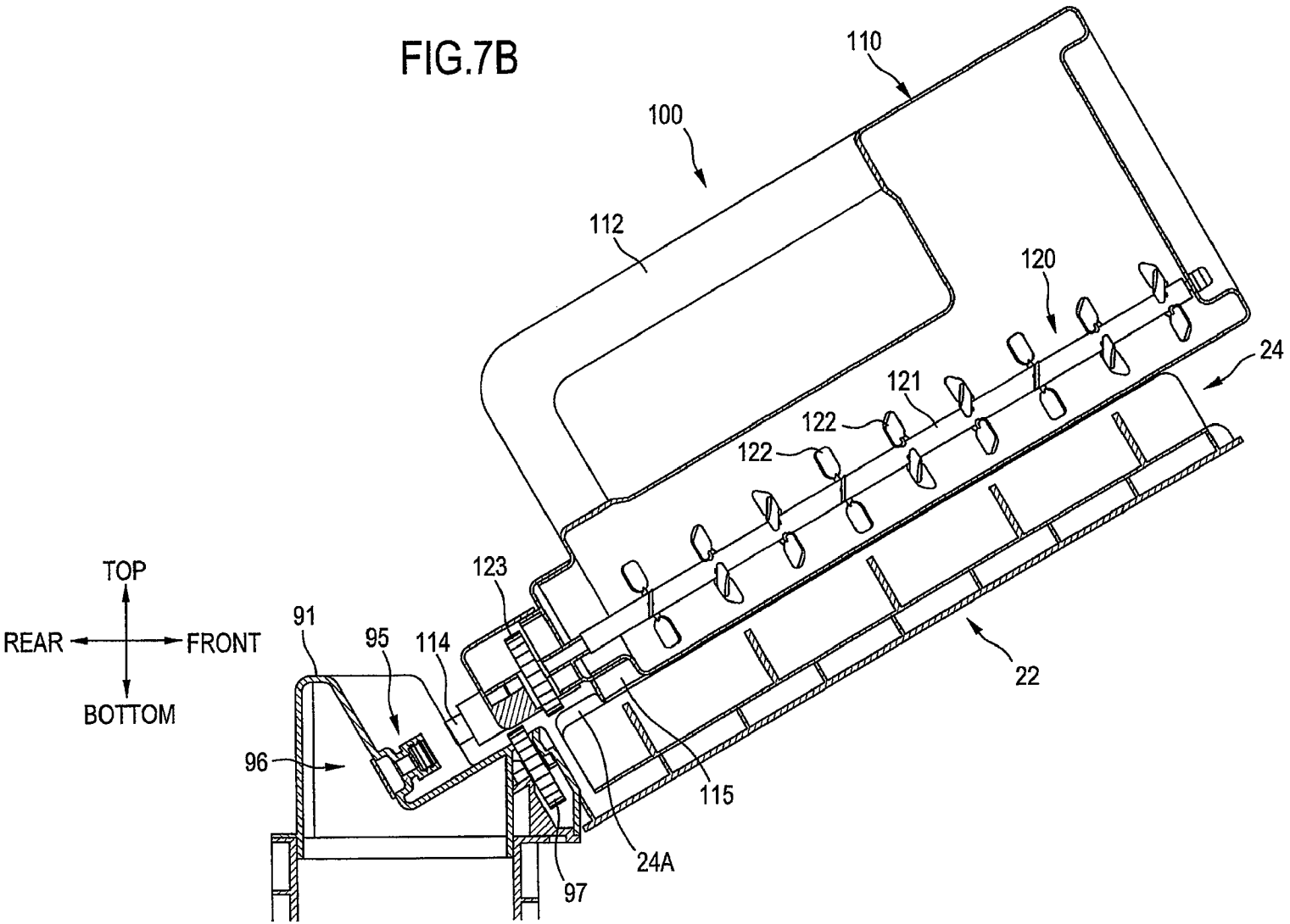
FIG. 7B is a cross-sectional view of the bottle mounted on the liquid developer tank when the bottle has not been mounted properly.

However, when the specific pattern formed by the protruding parts 24A does not match the specific pattern formed by the recessed parts 117, as shown in FIG. 7B, the sensing unit 115 contacts the tops of the protruding parts 24A, preventing the liquid developer bottle 100 from moving further downward. Since the bottle side mounting part 114 cannot be engaged with the mounting part 95, the input gear 123 and the drive gear 97 are also not engaged.

The liquid carrier bottle 100C is detachably mounted in the main casing 2 (on the corresponding mounting part 95) and functions to accumulate liquid carrier to be supplied to the liquid carrier tank 92. The liquid carrier bottle 100C has a liquid carrier accumulating section 111C (see FIG. 6). The structure of the liquid carrier bottle 100C is substantially the same as the liquid developer bottles 100, except that the capacity of the liquid carrier accumulating section 111C is greater than the capacity of the liquid developer accumulating section 111, and the agitator 120 is not provided in the liquid carrier accumulating section 111C. Therefore, a detailed description of the liquid carrier accumulating section 111C will not be given.

Figure 8:
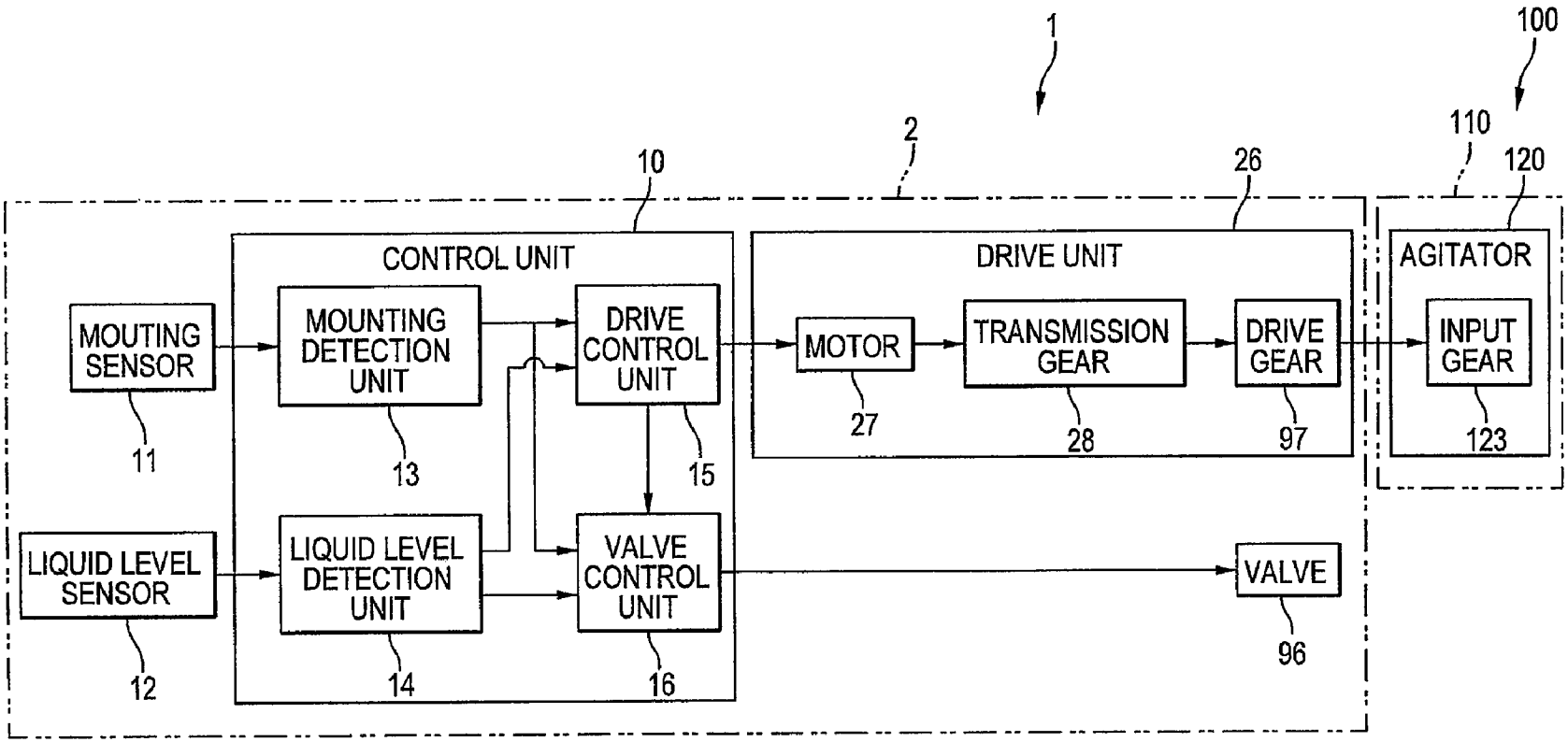
FIG. 8 is a block diagram showing the structure of a control unit and a drive unit.

As shown in FIG. 8, the color printer 1 is provided with the control unit 10 at a suitable position in the main casing 2 for controlling opening and closing of the valve 96 and driving of the drive gear 97. Although not shown in the drawings, the control unit 10 is configured of a CPU, RAM, ROM, input/output circuit. The color printer 1 also includes a mounting sensor 11 disposed on each of the mounting parts 95 for detecting mounting of the liquid developer bottles 100 and the liquid carrier bottle 100C, and a liquid level sensor 12 disposed inside each of the tanks 91 and 92 for detecting the level of liquid developer and liquid carrier.

The primary functional units within the control unit 10 are a mounting detection unit 13, a liquid level detection unit 14, a drive control unit 15, and a valve control unit 16. The mounting detection unit 13 detects whether or not the bottle side mounting part 114 on one of the liquid developer bottles 100 or the liquid carrier bottle 100C is engaged with the corresponding mounting part 95 based on detection from the mounting sensors 11.

The liquid level detection unit 14 detects whether or not the level of liquid developer or liquid carrier accumulated in one of the liquid developer tanks 91 or the liquid carrier tank 92 has dropped to less or equal to a prescribed value based on output from the liquid level sensors 12. The prescribed value is calculated by subtracting the amount of liquid developer or liquid carrier accumulated in the liquid developer bottle 100 or the liquid carrier bottle 100C from the maximum liquid capacity in the liquid developer tank 91 or the liquid carrier tank 92. This prescribed value has already stored in advance.

The drive control unit 15 controls a drive unit 26 provided in the main casing 2 based on detection results from the mounting detection unit 13 and the liquid level detection unit 14 in order to drive the agitator 120 in each liquid developer bottle 100. The drive unit 26 includes the motor 27 serving as the drive source, a plurality of transmission gears 28 for transmitting the drive force of the motor 27 to the drive gear 97, and the drive gear 97.

The valve control unit 16 controls opening and closing of the valve 96. Specifically, the valve control unit 16 opens the valve 96 upon receiving a signal from the drive control unit 15 instructing that the agitator 120 be driven for a prescribed time. The valve control unit 16 closes the valve 96 after the prescribed time has elapsed.

Figure 9:
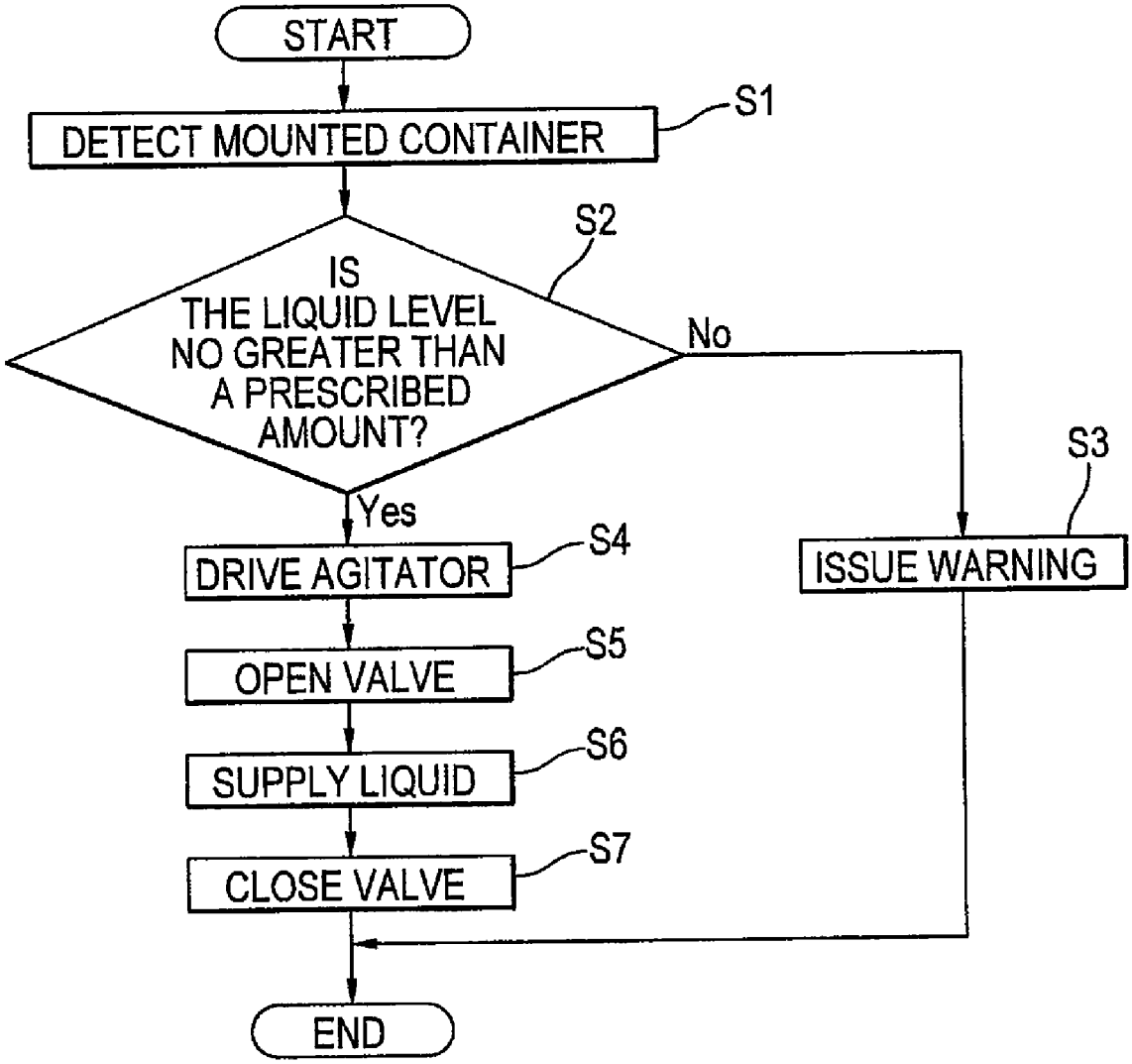
FIG. 9 is a flowchart illustrating steps in an operation performed by a color printer when the bottle is mounted on the liquid developer tank.

Next, the operations and effects of the color printer 1 having the above construction will be described. FIG. 9 is a flowchart illustrating steps in an operation performed on the color printer 1 when liquid developer is supplied.

First, it will be assumed that the front cover 21 has been rotated forward and the upper cover 22 has been rotated open, as shown in FIG. 2. In this state, the mounting part 95 (inlet 95A) provided in the upper front area of the main casing 2 is exposed from the top.

Next, one of the liquid developer bottles 100 or the liquid carrier bottle 100C is placed on top of the open upper cover 22, i.e., on the ribs 24. If the specific pattern of the ribs 24 matches the specific pattern of the sensing unit 115, as illustrated in FIGS. 5B-7A, the protruding parts 24A engage in the recessed parts 117, allowing the bottle side mounting part 114 to engage with the mounting part 95. Consequently, the liquid developer bottle 100 or the liquid carrier bottle 100C is successfully mounted on the main casing 2, with the input gear 123 engaged with the drive gear 97.

However, when the specific pattern formed by the protruding parts 24A does not match the specific pattern formed by the recessed parts 117, as shown in FIG. 7B, the sensing unit 115 contacts the tops of the protruding parts 24A, preventing the liquid developer bottle 100 from moving further downward. Since the bottle side mounting part 114 cannot be engaged with the mounting part 95, the input gear 123 and the drive gear 97 are also not engaged.

By providing specific patterns in the ribs 24 and the sensing units 115 in this way so that the patterns must be aligned in order to mount the liquid developer bottles 100 and the liquid carrier bottle 100C on the corresponding mounting parts 95, this construction can prevent the bottles 100 and 100C from being incorrectly mounted. Therefore, this configuration prevents liquid carrier or liquid developer having dispersed toner of one of the colors cyan, magenta, or yellow from being supplied into the liquid developer tank 91 accumulating black liquid developer, for example, and prevents liquid developer from being supplied into the liquid carrier tank 92.

Further, the upper cover 22 slopes diagonally upward from the inlets 95A when opened, and the protruding parts 24A are provided in an area of the upper cover 22 near the inlets 95A. Therefore, if the operator mounts the bottle 100 or 100C incorrectly, the bottle 100 or 100C is supported on the ribs 24 with the sensing unit 115 contacting the top ends of the protruding parts 24A as shown in FIG. 7 B. Hence, the user need not continually hold the bottle 100 or 100C, thereby enhancing operability of the color printer 1. Further, once the bottle 100 or 100C has been placed on the main casing 2, the bottle 100 or 100C is not likely to fall off the upper cover 22, even when the user releases the bottle.

The operation when the bottle is mounted in the liquid developer tank will be described below. After the liquid developer bottle 100 or the liquid carrier bottle 100C has been mounted on the main casing 2, in S1 of FIG. 9 the control unit 10 detects that the bottle 100 or 100C has been mounted. Although not described in FIG. 9, the control unit 10 maintains the valve 96 in a close state whenever the bottle 100 or 100C is not mounted on the main casing 2.

In S2 the control unit 10 determines whether or not the level of liquid developer or liquid carrier accumulated in the liquid developer tank 91 or the liquid carrier tank 92 is lower than the prescribed value.

If the level of liquid developer accumulated in the tank 91 or 92 exceeds the prescribed value (S2: NO), then in S3 the control unit 10 performs an operation to display an error message on a display unit (not shown) of the main casing 2 or output a warning sound and subsequently ends the process in FIG. 9. During this time, the control unit 10 performs control to maintain the valve 96 in a close state. Therefore, the user removes the bottle 100 or 100C since liquid developer or liquid carrier cannot be supplied at this time. Hence, this configuration prevents leakage of liquid developer and liquid carrier by not permitting excess liquid developer and liquid carrier to be supplied to the tanks 91 and 92.

However, if the control unit 10 determines in S2 that the level of liquid accumulated in the tank 91 or 92 is lower than the prescribed level (S2: Yes), in S4 the control unit 10 begins driving the motor 27 in the drive unit 26, which drive force is transferred to the input gear 123 via the transmission gears 28 and the drive gear 97, causing the input gear 123 to rotate and drive the agitator 120 in the liquid developer bottle 100. In this way, the liquid developer accumulated in the liquid developer bottle 100 can be agitated prior to being supplied into the liquid developer tank 91, ensuring that the toner in the liquid developer is uniformly dispersed.

Although not described in FIG. 9, the control unit 10 may skip S4 and advance to S5 described later when the liquid carrier bottle 100C is mounted since the liquid carrier bottle 100C supplies only liquid carrier, which does not need agitating and the liquid carrier bottle 100C dose not have agitator.

After driving the agitator 120 for a predetermined time, in S5 the control unit 10 opens the valve 96 since the bottle 100 or 100C is in fluid communication with the tank 91 or 92 via the inlet 95A, as shown in FIG. 5B. Opening the valve 96 allows liquid developer or liquid carrier to flow from the bottle 100 or 100C into the tank 91 or 92. Accordingly, in S6 liquid developer or liquid carrier accumulated in the bottle 100 or 100C is supplied to the tank 91 or 92. By driving the agitator 120 for a predetermined time before the control unit 10 opens the valve 96, the toner in the liquid developer is sufficiently agitated and toner in the liquid developer can be sufficiently dispersed.

After a predetermined time has elapsed for supplying the total amount of liquid developer in the liquid developer bottle 100 to the liquid developer tank 91, in S7 the control unit 10 closes the valve 96. At this time, the control unit 10 may also display a message on the display unit of the main casing 2 or output a sound or voice message to indicate that the supply operation is complete.

Once the supply of liquid developer is complete, the user removes the bottle 100 or 100C and rotates both the upper cover 22 and the front cover 21 closed as shown in FIG. 1. The control unit 10 also be may configured to halt the agitator 120 in S5 after the agitator 120 has been driven for the prescribed time, or may be configured to halt the agitator 120 after supply of the liquid developer is complete.

With the color printer 1 having the above construction, the bottles 100 and 100C are supported on the open upper cover 22, i.e. the plurality of ribs 24, in an orientation for supplying a liquid developer or liquid carrier into the liquid developer tank 91 or the liquid carrier tank 92. Therefore, the user need not remain holding the heavy liquid developer bottle 100 or liquid carrier bottle 100C while supplying liquid developer or liquid carrier, thereby reducing the burden on the user when supplying liquid developer or liquid carrier and, hence, improving operability of the color printer 1 for supplying liquid developer or liquid carrier.

While the invention has been described in detail with reference to specific embodiments thereof, it would be apparent to those skilled in the art that many modifications and variations may be made therein without departing from the spirit of the invention, the scope of which is defined by the attached claims.

In the embodiment described above, the liquid developer bottle 100 or the liquid carrier bottle 100C is supported by the plurality of ribs 24 provided on the upper cover 22. However, the present invention is not limited to this configuration. For example, the entire top surface of the open upper cover 22 may serve as the support surface for directly mounting the bottles thereon. However, since the weight of the upper cover 22 can be reduced by constructing the plurality of ribs 24 on the cover 22, this construction is effective to reducing the weight of the entire color printer 1 and eliminates the need to reinforce the structure of parts that receive the support point (rotational shaft) of the upper cover 22. Intersecting the ribs 24 with the reinforcing ribs 25 in the preferred embodiment not only achieves a light upper cover 22, but also improves the strength of the strength of the upper cover 22 itself.

The embodiment described above employs the upper cover 22 as an example of the cover, but the present invention is not limited to this configuration. For example, the front cover 21 may be employed as another example of the cover. Further, the upper cover 22 slopes diagonally upward from the inlets 95A when opened to the maximum point, but the upper cover 22 of the present invention is not limited to this structure. For example, the top surface of the upper cover 22 may be substantially horizontal when opened to the maximum point.

In the embodiment described above, the protruding parts 24A is provided at the cover-side, while the sensing units 115 (recessed parts 117) is provided at the bottle-side, but the present invention is not limited to this construction. For example, recessed parts may provide on the cover-side and the protruding parts on the bottle side. Further, the protruding parts 24A on the cover side may be provided over the entire surface of the support part.

The embodiment described above employs the agitator 120 having the shaft 121 and a plurality of the agitating blades 122, but the present invention is not limited to this configuration. Any type of agitating member well known in the art may be suitably employed, provided that the agitating member can agitate liquid developer accumulated in a bottle mounted on the device body.

In the embodiment described above, the input gear 123 is meshed with the drive gear 97, but the present invention is not limited to this configuration. For example, it is possible to employ a bottle-side coupling fixed to a shaft end of the agitator that protrudes out of the bottle frame 110, and a device-body-side coupling engaged with the bottle-side coupling.

The embodiment describes a process for closing the valve 96 after a predetermined time has elapsed, but the method for determining when to end the supply of liquid is not limited to this method. For example, the control unit 10 may determine to end the supply of liquid developer when the amount of liquid in the tank 91 or tank 92 stops increasing, or when the level of liquid in the tank 91 or tank 92 reaches a preset level. The present invention preferably includes a structure that prevents detachment of the bottle while liquid developer (liquid carrier) is being supplied therefrom.

In the embodiment described above, the image forming device employs liquid developer formed of the developing agent and the liquid carrier, but the present invention is not limited in this configuration. For example, the image forming device may employ a color material (e.g., the liquid developer or an ink).

While the color printer 1 in the embodiment described above serves as the image-forming device of the present invention, the present invention is not limited to this example. The present invention may be applied to a multifunction device or photocopier employing a liquid development system. Further, the liquid developer bottle of the present invention may be applied to a monochromatic printer, a multifunction device, a photocopier, or the like.

What is claimed is:

1. An image forming device comprising:

a casing;

an accumulation unit provided in the casing and configured to accumulate therein one of liquid developer and liquid carrier;

a supply inlet in communication with the accumulation unit and configured to be fluidly connectable with a replenishing container containing the one of the liquid developer and the liquid carrier;

a cover configured to selectively provide an open phase and a closed phase with respect to the casing, and configured to expose the supply inlet at the open phase; and, a support part provided on the cover and configured to detachably mount thereon the replenishing container at the open phase in an orientation capable of discharging the one of the liquid developer and the liquid carrier into the accumulation unit through the supply inlet, wherein the replenishing container has an outer surface provided with an engagement part having a first specific pattern, and wherein the support part is provided with complementary engagement part having a second specific pattern and engageable with the engagement part of the replenishing container when the outer surface of the replenishing container is mounted on the support part, the replenishing container configured to be fluidly connectable to the supply inlet only by the engagement between the engagement part and the complementary engagement part.

2. The image forming device according to claim 1, wherein the support part slopes diagonally upward from a position near the supply inlets at the open phase of the cover; and wherein the complementary engagement part is provided in an area of the cover near the supply inlets.

3. The image forming device according to claim 1, wherein the support part comprises first ribs protruding from the cover upward at the open phase of the cover, and reinforcement ribs protruding from the cover upward at the open phase of the cover and intersecting with the first ribs, the first ribs having regions functioning as the complementary engagement part.

4. The image forming device according to claim 3, wherein the regions of the first ribs provide protruding lengths of the first ribs greater than that of a remaining portion of the first ribs to provide the second specific pattern.

5. The image forming device according to claim 1, wherein the replenishing container comprises:

a container bottle configured to contain therein the liquid developer;

an agitating member rotatably provided in the container bottle and configured to agitate the liquid developer; and, a drive input part interlocked with the agitating member; and wherein the image forming device further comprises a drive transmission mechanism engageable with the drive input part upon engagement of the engagement part with the complementary engagement part.

6. The image forming device according to claim 5, further comprising:

a supply valve that opens and closes the supply inlets;

a control unit that controls the opening and closing of the supply valve; and a sensor that detects an amount of one of the liquid developer and the liquid carrier accumulated in the accumulation unit, wherein as long as the engagement part is engaged with the complementary engagement part, the control unit is configured to open the supply valve if the amount detected by the sensor is less than a prescribed amount, and to prevent the supply valve from opening when the amount detected by the sensor exceeds the prescribed amount.

7. The image forming device according to claim 6, wherein the control unit is configured to drive the drive transmission mechanism upon fluid connection of the replenishing container with the supply inlet; and, wherein the control unit is configured to open the supply valve after the drive transmission mechanism is operated for a prescribed time period.

8. The image forming device according to claim 1, wherein the support part slopes diagonally upward from a position near the supply inlets at the open phase of the cover; and wherein the complementary engagement part is provided in an area of the cover near the supply inlets.

9. The image forming device according to claim 1, wherein the support part comprises first ribs protruding from the cover upward at the open phase of the cover, and reinforcement ribs protruding from the cover upward at the open phase of the cover and intersecting with the first ribs, the first ribs having regions functioning as the complementary engagement part.

10. The image forming device according to claim 9, wherein the regions of the first ribs provide protruding lengths of the first ribs greater than that of a remaining portion of the first ribs to provide the second specific pattern.

11. The image forming device according to claim 1, wherein the replenishing container comprises:

a container bottle configured to contain therein the color material;

an agitating member rotatably provided in the container bottle and configured to agitate the color material; and, a drive input part interlocked with the agitating member; and wherein the image forming device further comprises a drive transmission mechanism engageable with the drive input part upon engagement of the engagement part with the complementary engagement part.

12. The image forming device according to claim 11, further comprising:

a supply valve that opens and closes the supply inlets;

a control unit that controls the opening and closing of the supply valve; and a sensor that detects an amount of the color material accumulated in the accumulation unit, wherein as long as the engagement part is engaged with the complementary engagement part, the control unit is configured to open the supply valve if the amount detected by the sensor is less than a prescribed amount, and to prevent the supply valve from opening when the amount detected by the sensor exceeds the prescribed amount.

13. The image forming device according to claim 12, wherein the control unit is configured to drive the drive transmission mechanism upon fluid connection of the replenishing container with the supply inlet; and, wherein the control unit is configured to open the supply valve after the drive transmission mechanism is operated for a prescribed time period.

14. An image forming device configured to form an image with color material, the image forming device comprising:

a casing;

an accumulation unit provided in the casing and configured to accumulate therein color material;

a supply inlet in communication with the accumulation unit and configured to be fluidly connectable with a replenishing container containing the color material;

a cover configured to selectively provide an open phase and a closed phase with respect to the casing, and configured to expose the supply inlet at the open phase; and, a support part provided on the cover and configured to detachably mount thereon the replenishing container at the open phase in an orientation capable of discharging the color material into the accumulation unit through the supply inlet, wherein the replenishing container has an outer surface provided with an engagement part having a first specific pattern, and wherein the support part is provided with complementary engagement part having a second specific pattern and engageable with the engagement part of the replenishing container when the outer surface of the replenishing container is mounted on the support part, the replenishing container configured to be fluidly connectable to the supply inlet only by the engagement between the engagement part and the complementary engagement part.

* * * * *